US006484408B1

(12) United States Patent
Dove

(10) Patent No.: US 6,484,408 B1
(45) Date of Patent: Nov. 26, 2002

(54) CUTTING DEVICE

(76) Inventor: Lawrence Alexander Dove, 56 Fraser St., Tauranga 3001 (NZ)

( * ) Notice: Subject to any disclaimer, the term of this patent is extended or adjusted under 35 U.S.C. 154(b) by 0 days.

(21) Appl. No.: 09/786,166

(22) PCT Filed: Jul. 27, 1999

(86) PCT No.: PCT/NZ99/00115

§ 371 (c)(1),
(2), (4) Date: Jun. 7, 2001

(87) PCT Pub. No.: WO00/12272

PCT Pub. Date: Mar. 9, 2000

(30) Foreign Application Priority Data

Aug. 28, 1998 (NZ) ..... 331569

(51) Int. Cl.[7] ..... B26B 17/02

(52) U.S. Cl. ..... 30/360; 30/358; 30/366; 30/363

(58) Field of Search ..... 30/358, 360, 361, 30/362, 363, 366, 368

(56) References Cited

U.S. PATENT DOCUMENTS 3,255,526 A * 6/1966 Molitor ..... 30/360
3,273,241 A * 9/1966 Annes ..... 30/360
3,391,460 A * 7/1968 Moore ..... 30/358
4,087,913 A 5/1978 Jackson
4,096,964 A 6/1978 Glick
4,730,395 A * 3/1988 Blessing, Sr. ..... 30/360
4,899,447 A * 2/1990 Adleman ..... 30/360
4,951,395 A 8/1990 Lameiro
4,969,269 A 11/1990 Dominguez
5,117,720 A * 6/1992 Bussi ..... 30/366

* cited by examiner

*Primary Examiner*—Hwei-Siu Payer
(74) *Attorney, Agent, or Firm*—D. Peter Hochberg; Katherine R. Vieyra; Sean Mellino

(57) ABSTRACT

A hole cutting device comprises a spike for driving through a sheet of material; at least one handle located on the spike at an end opposite to that of the tip of the spike; a first cutting member located on the spike and substantially adjacent the handle, a cutting edge of the first cutting member to be positioned substantially adjacent a first side of the sheet of material; a second cutting member located on the spike and joined with the first cutting member, a cutting edge of the second cutting member to be positioned substantially adjacent a second side of the sheet of material; and the handle moving the first cutting member toward the second cutting member to cut a hole in the sheet of material by the cutting edges.

15 Claims, 2 Drawing Sheets

CUTTING DEVICE

TECHNICAL FIELD

This invention relates to a hole cutting device.

BACKGROUND ART

In particular this invention relates to a hole cutting device adapted for cutting holes in sheets of material.

In general, the present invention relates to a device for cutting holes in sheets of plasterboard, such as those sold in New Zealand under the GIB™ brand name, and used as interior wall liners in buildings. However, this should not be seen as limiting, as the present invention may also have application to other types of sheets of material.

In practice, prior to plasterboard being affixed to the framing of a building, holes must be cut in the plasterboard which correspond with the location of switchboxes (i.e. for light switches/power points) attached to the framing.

Currently holes for switchboxes are created using a knife such as a STANLEY™ knife to cut both sides of the plasterboard into a shape which substantially corresponds to that of the switchbox.

However, as should be appreciated this method of cutting holes for switchboxes suffers from a number of drawbacks.

One drawback with this method is that it is unnecessarily time consuming—due to the requirement to cut both sides of the plasterboard.

A further drawback with this method is that often builders do not cut holes which substantially correspond with the shape/dimensions of the switchbox. As a result, electricians often have difficulty accessing the mounting holes in the switchbox to which the light switch/power point covers are attached. Consequently, electricians often have to hack at the hole created by the builder so as to access the mounting hole which risks visible damage occurring to the plasterboard which may not be covered by the switch/power-point covers.

It is an object of the present invention to address the foregoing problems or at least to provide the public with a useful choice.

It would also be useful if there could be provided a device which is able to cut both sides of a sheet of plasterboard so as to ensure the structural rigidity of the plasterboard is not compromised.

Further aspects and advantages of the present invention will become apparent from the ensuing description which is given by way of example only.

DISCLOSURE OF INVENTION

According to one aspect of the present invention there is provided a hole cutting device characterised in that the device includes:

a spike capable of being driven through a sheet of material;

at least one handle which is or can be located on the spike at the opposite end to that of the tip;

a first cutting member capable of being located on the spike such that:

a) the first cutting member is positioned substantially adjacent the handle(s); and b) the cutting edge(s) of the member can be positioned substantially adjacent a first side of the sheet of material;

a second cutting member capable of being located on the spike such that:

a) the spike is effectively united with the member; and b) the cutting edge(s) of the member can be positioned substantially adjacent a second side of the sheet of material;

the device further characterised in that the handle(s) is/are adapted so as to be capable of moving the first cutting member along the spike towards the second cutting member so as to cause the respective cutting edges of the cutting members to cut a hole in the sheet of material therebetween.

According to another aspect of the present invention there is provided a hole cutting device substantially as described above wherein the cutting edge(s) of the first and second cutting members have the same or similar external outlines.

According to a further aspect of the present invention there is provided a hole cutting device wherein the cutting edges of the first and second cutting members have the same or similar dimensions.

According to another aspect of the present invention there is provided cutting members adapted to be used with a hole cutting device substantially as described herein.

According to another aspect of the present invention there is provided a set of cutting members adapted to be used with a hole cutting device substantially as described herein.

According to a further aspect of the present invention there is provided a method of cutting a hole in a sheet of material characterised by the steps of.

a) driving a spike through the sheet of material; and b) fitting at least one cutting member to the spike so that two cutting members are positioned on either side of the sheet of material such that the cutting edge(s) of the members are positioned substantially adjacent the sheet of material; and c) moving the cutting members towards one another so as to cut a hole in the sheet of material therebetween.

According to another aspect of the present invention there is provided a kit of parts for assembling a hole cutting device, said kit including:

a) a spike capable of being driven through a sheet of material;

b) at least one handle which is or can be located on the spike at the opposite end to that of the tip; said handle(s) being adapted so as to be capable of moving the first cutting member along the spike;

c) a first cutting member capable of being located on, the spike such that:

(i) the first cutting member is positioned substantially adjacent the handle(s); and (ii) the cutting edge(s) of the member can be positioned substantially adjacent a fist side of the sheet of material.

d) a second cutting member capable of being located on the spike such that:

(i) the spike is effectively united with the member; and (ii) the cutting edge(s) of the member can be positioned substantially adjacent a second side of the sheet of material.

It is envisaged that the spike may have a number of different configurations.

In general, the spike will be a member whose length is substantially longer than its width.

In some embodiments the spike may have a substantially circular cross-section.

In preferred embodiments the spike may have a substantially square transverse cross-section.

In general it is envisaged the sheet of material may be any sheet of substantially rigid material. However, this should not be seen as limiting.

In preferred embodiments the sheet of material may be plasterboard.

The handle(s) may have a number of different configurations provided the handle(s) is/are capable of being grasped.

In preferred embodiments the handle(s) may be pivotally attached to the spike.

In some other embodiments, the handle may have a threadable core capable of engaging a threaded region of the spike.

The first cutting member may have a number of different outward configurations.

In general, the first cutting member may have a substantially rectangular external outline, although this should not be seen as limiting.

The first cutting member may be adapted so as to be capable of being located on the spike in a variety of different ways.

In preferred embodiments, the first cutting member may include an aperture of a size and shape that substantially corresponds to the transverse cross-sectional profile of the spike, on which it is to be located. The aperture being such as to allow the first cutting member to easily slide along the spike.

The second cutting member may have a number of different outward configurations.

In general, the second cutting member may have a substantially rectangular external outline, although this should not be seen as limiting.

The second cutting member may be adapted so as to be capable of being located on the spike in a variety of different way.

In preferred embodiments, the second cutting member may include an aperture of a size and shape that substantially corresponds to the transverse cross-sectional profile of the spike, on which it is to be located. The aperture being such as to allow the second cutting member to easily slide along the spike.

It is envisaged that the second cutting member may be capable of being effectively united with the spike in a variety of different ways.

In some embodiments, the second cutting member may have its aperture shaped/orientated so that it is capable of interlocking with a recess/protrusion on the spike. Thus, a second cutting member may effectively interlock with a recess/protrusion on the spike when it is rotated from a first orientation to a second orientation; such that the recess/protrusion on the spike prevents the cutting member being slid back off the spike.

In preferred embodiments, the second cutting member may be effectively united to the spike via a pin which passes through the spike and protrudes therefrom to prevent the second member from moving back off the spike.

In preferred embodiments, the first cutting member may also include markings which enable the spike to be easily aligned with the central point of the hole to be cut from the sheet of material.

The cutting edges on the first and second cutting members may be a variety of external outlines so as to create a number of differently shaped holes.

In preferred embodiments, the cutting edges may have a substantially rectangular outline so as to cut a rectangular hole in the sheet of material. However, this should not necessarily be seen as limiting.

The cutting edges of the first and second cutting members may have a variety of different configurations provided 1the edges are capable of cutting holes in the sheet of material.

It is envisaged the handle(s) may be adapted in a number of ways so as to be capable of moving the first cutting member along the spike towards the second cutting member.

EXAMPLE 1

In one preferred embodiment, the handle(s) may include a cam portion which is able to contact and move the first cutting member towards the second cutting member when the handle is pivoted.

EXAMPLE 2

In another preferred embodiment, where the core of the handle is threaded, the handle may simply be screwed further onto the spike so as to move the first cutting member towards the second cutting member.

EXAMPLE 3

In a further preferred embodiment, the handle(s) may include a substantially curved end portion extending past a pivot axis, said curved end portion being capable of contacting and moving the first cutting member towards the second cutting member, as the handle(s) are pivoted.

EXAMPLE 4

In a further preferred embodiment substantially similar to Example 3, the handle(s) may pivot about a point off-centre with the central longitudinal axis/axes of the handle(s); dependent on the orientation of the handle(s), the first cutting member may be positioned, prior to pivoting the handle(s), either closer to, or further away, from the second cutting member.

Consequently, the hole cutting device is capable of cutting thicker or thinner sheets of material—dependent on the initial orientation of the handles prior to cutting.

In use, the first cutting member may already be positioned on the spike at the time it is initially driven through the sheet of material. Consequently, in this instance all that is required is to fit and unite the second cutting member to the spike.

However, this should not be seen as limiting, as in some embodiments once a spike has been driven through the sheet of material, the spike may be withdrawn to allow for the fitting of the first and second cutting members thereto.

The first cutting member being fitted to the spike first before the spike is reinserted through the hole it made in the sheet of material. At which point the second cutting member may then be located on and united to the spike on the other side of the sheet of material.

Thus preferred embodiments of the present invention may have a number of advantages over the prior art which can include:

1. The provision of a quick and efficient device/method for cutting hole(s) of uniform size in sheets of material.
2. The ability to cut both sides of the sheet of material so that the structural rigidity of the sheet of material is maintained (i.e. there is no unnecessary ripping away of portions of the cardboard outer surface of the plasterboard).
3. The apparatus/method being more time efficient than the existing methods for cutting holes in sheets of material.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
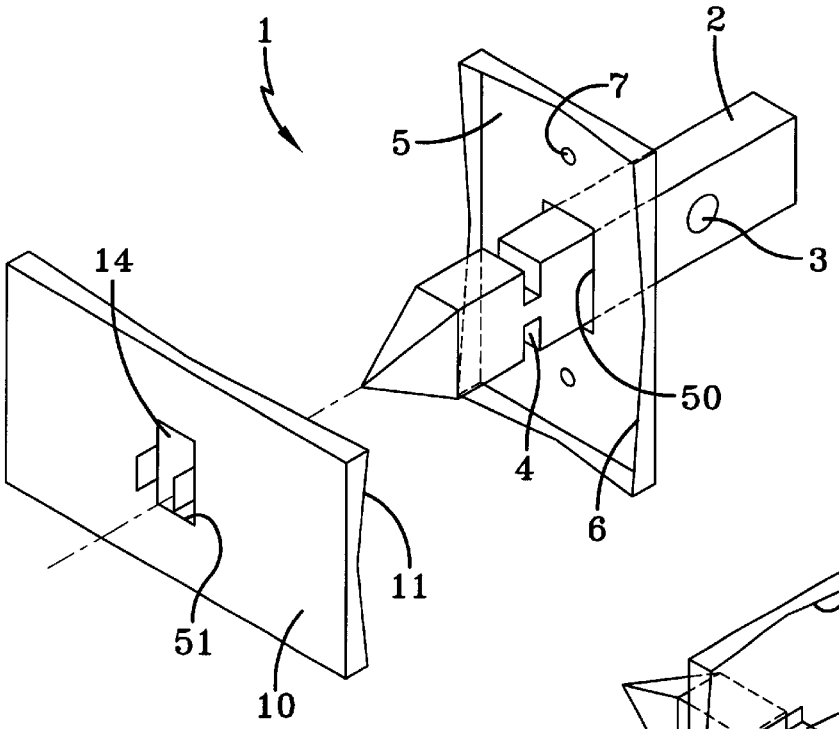
FIG. 1 is a perspective view of one preferred embodiment of the present invention illustrating how the first cutting member may be attached to the spike.
Figure 2:
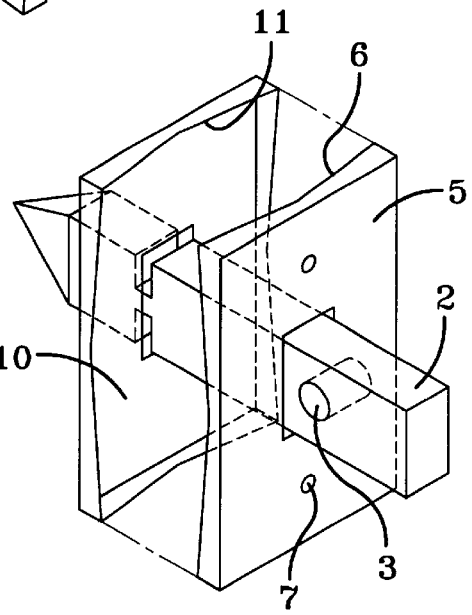
FIG. 2 is a perspective view showing the first and second members located on the spike.
Figure 3:
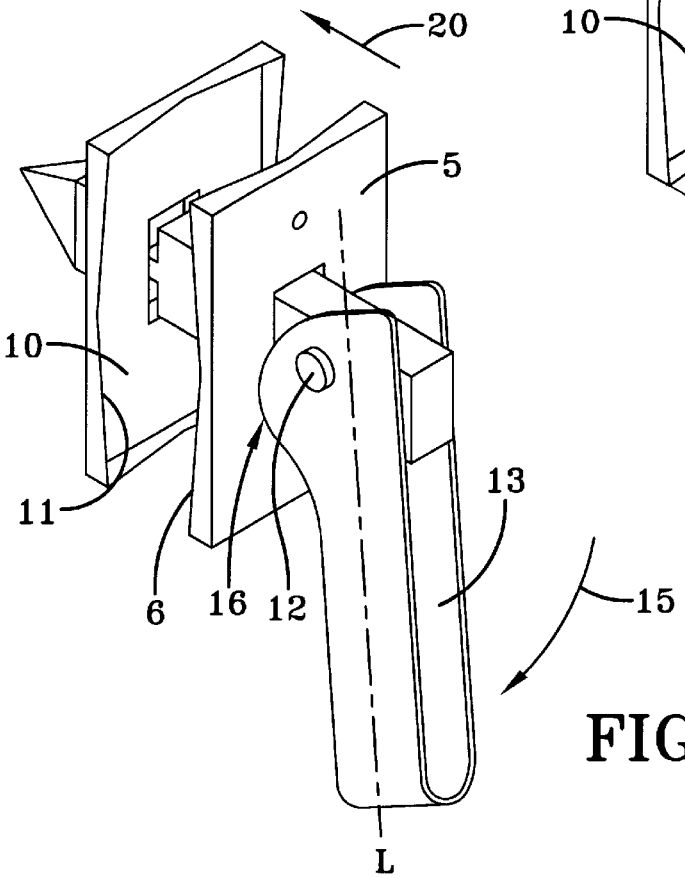
FIG. 3 is a diagrammatic view illustrating how the second cutting member can be moved towards the first cutting member so as to cut a sheet of material.

With respect to FIGS. 1–3 there is shown a hole cutting device generally indicated by arrow 1.

In FIG. 1 there is shown a spike 2, including an aperture 3 and a recess 4. Located on the spike 2 is a first cutting member 5 which has a peripheral cutting edge 6. The cutting member 5 also includes small apertures 7. The apertures 7 allow for objects such as nails to be pushed therethrough so as to push out any plasterboard wedged in between the cutting edge 6, after the cutting operation is complete.

Also shown is a second cutting member 10 having a cutting edge 11. The first and second cutting members 5, 10 include apertures 50, 51 which allow them to be attached to the spike. The second cutting member 10 is shown orientated substantially horizontally for location of its aperture 14 onto the spike 2.

Once the cutting member 10 reaches the recess 4 it is rotated 90 degrees so as to effectively interlock aperture 14 with the recess 4 as shown in FIG. 2.

The aperture 3 in the spike 2 receives a pin 12 which pivotally attaches a handle 13 to the spike 2 as shown in FIG. 3. The pin 12 can be a pivot axis or point off-centre. The handle has a central longitudinal axis L. It should be appreciated that the handle 13 is generally permanently attached to the spike 2, but is not shown in FIGS. 1 and 2 so that the other components may be more easily seen.

In use, the spike 2 is first driven through the sheet of material (not shown) and then withdrawn, so that the first cutting member 5 may be attached to the spike 2 substantially as shown.

The spike 2 is then re-inserted into the hole it has just created in the sheet of material so that the second cutting member 10 may be attached to the spike 2 also substantially as shown.

Thus, it will be appreciated that when the cutting device 1 is assembled as is shown in FIG. 3, a sheet of material (not shown) will be located between the first and second cutting members 5, 10.

To cut the sheet of material, the handle 13 is rotated from a substantially horizontal position, in the direction indicated by arrow 15. This causes a cam portion or curved end portion 16 on handle 13 to force the first cutting member 5 to move towards the second cutting member 10 as indicated by arrow 20. As a consequence of this, the sheet of material ends up getting cut by the respective cutting edges 6, 11 of cutting members 5 and 10 due to the squeeze action created by the handle 13.

Figure 4:
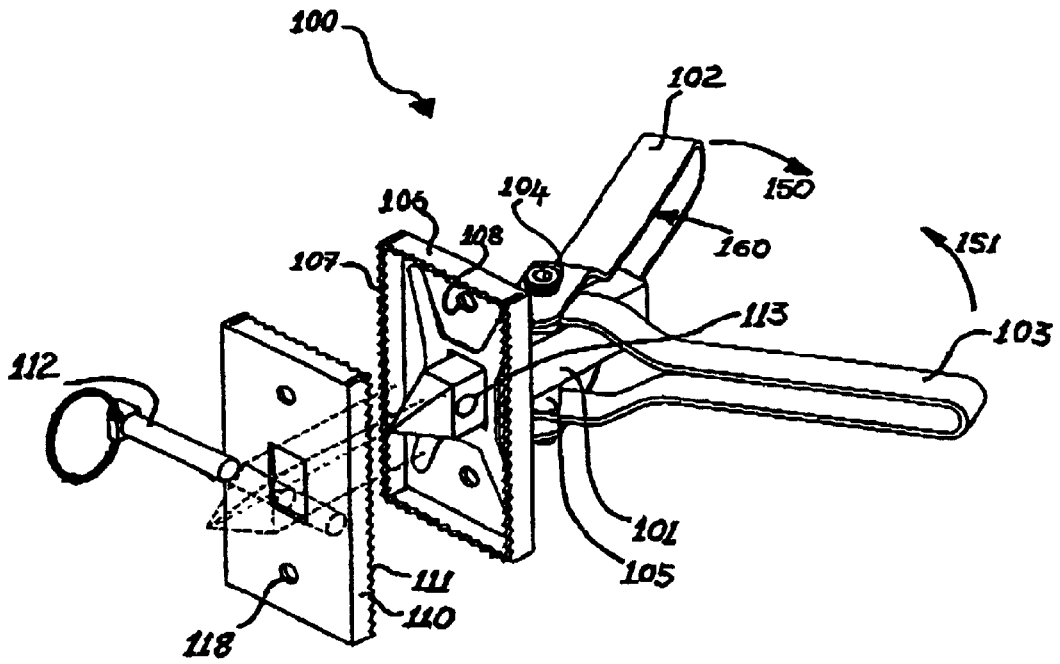
FIG. 4 is a perspective view of another preferred embodiment of the present invention.

It will be appreciated by those skilled in the art, that in practice the cutting members 5, 10 would be a lot closer together than is shown in FIG. 3 when the handle 13 has the orientation shown With respect to FIG. 4 there is illustrated a hole cutting device generally indicated by arrow 100.

The cutting device 100 has a spike 101 and handles 102 and 103. The handles 102, 103 are attached to the spike 101 via a nut and bolt 104, 105.

Located on the spike 101 is a first cutting member 106 which has a peripheral saw tooth cutting edge 107. The cutting member 106 also includes small apertures 108. The apertures 108 allow for objects such as nails to be pushed therethrough, so as to push out any plasterboard (not shown) wedged in between the cutting edge 107, after the cutting operation is complete.

Also shown is a second cutting member 110 having a saw tooth peripheral cutting edge 111. The cutting member 110 also includes small apertures 118. The apertures 118 allow for nails to be pushed therethrough, so as to push out any plasterboard wedged in between, the cutting edge 111.

The second cutting member 110 is effectively united to the spike 110 via a lynchpin 112 which passes through aperture 113 in spike 101, as is indicated by the dotted outline.

The second cutting member 110 may also include reinforcement (not shown) in the region where it abuts the lynch pin 112. In general, this reinforcement may be in the form of an additional plate or plates which are welded to the outside of the second cutting member 110. However, this should not be seen as limiting as other means of reinforcing the second cutting member in this region are envisaged.

In use, the first cutting member 106 is attached to the spike 101 as shown and the spike 101 is then driven through the sheet of material (not shown). To allow the spike 101 to be driven through the sheet of material, the handles 102, 103 have a splayed orientation such that their respective longitudinal axes are substantially aligned with one another.

Once the spike 101 has been driven through the sheet of material, the second cutting member 110 is slid onto the spike and retained thereto, via the lynchpin 112 which passes through aperture 113 in spike 101.

To cut the sheet of material the handles 102, 103 are then rotated so that the terminal ends of the handles move towards one another as indicated by arrows 150 and 151.

In the embodiment shown, the handles 102, 103 pivot about bolt 105 which is positioned off-centre with respect to the central longitudinal axis of each handle 102, 103.

The handle 103 is of a size and shape, and is arranged so as to pass through the centre 160 of handle 102 this enables thick or thin sheets of material to be cut by the hole cutting device 100. Thus, thick or thin sheets of material can be cut simply by altering the side of the spike (i.e. left or right hand side) on which the handles 102, 103 are splayed with respect to each other.

Figure 5:
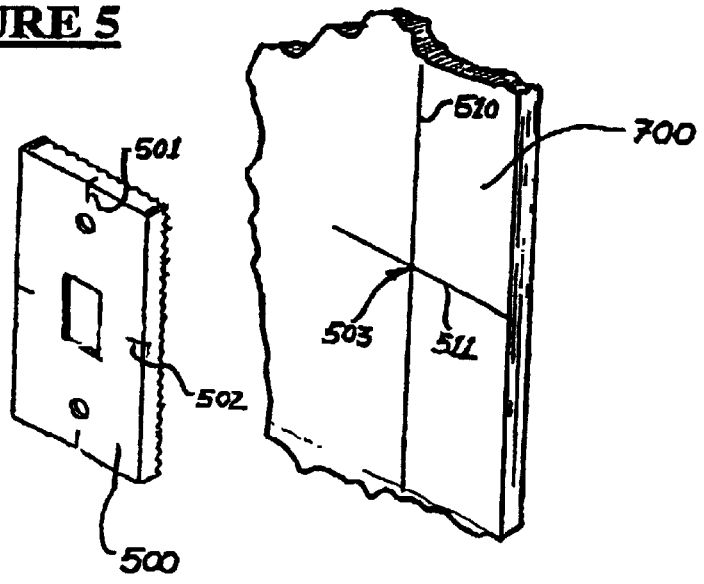
FIG. 5 is a perspective view of a first cutting member in accordance with one preferred embodiment of the present invention.

With respect to FIG. 5 there is shown a first cutting member 500 which includes marking 501, 502 which enable the spike to easily be aligned with the central point 503 of the hole to be cut in a sheet of material 700 (of which only a section is shown). The central point of the hole 503 to be cut is indicated by markings 510, 511 on the sheet of material 700.

Aspects of the present invention have been described by way of example only and it should be appreciated that modifications and additions may be made thereto without departing from the scope of the appended claims.

What I claim is:

1. A hole cutting device characterised in that the device includes:

a spike having a tip end and capable of being driven through a sheet of material;

at least one manually operated handle which is or can be located on the spike at the opposite end to that of the tip end;

a first cutting member having at least one cutting edge and capable of being located on the spike such that:

a) the first cutting member is positioned substantially adjacent the at least one handle; and b) the cutting edge of the first cutting member can be positioned substantially adjacent a first side of the sheet of material;

a second cutting member having at least one cutting edge and capable of being located on the spike such that:

a) the spike is joined with the second cutting member; and b) the cutting edge of the second cutting member can be positioned substantially adjacent a second side of the sheet of material;

the device further characterised in that the at least one handle is adapted so as to be capable of moving the first cutting member along the spike towards the second cutting member so as to cause the respective cutting edges of the cutting members to cut a hole in the sheet of material therebetween.

2. A hole cutting device substantially as claimed in claim 1 wherein the cutting edges of the first and second cutting members have the same general external outlines.

3. A hole cutting device as claimed in claim 2 wherein the cutting edge of the first and second cutting members have the same general dimensions.

4. A hole cutting device as claimed in claim 1 wherein the at least one handle comprises two handles pivotally attached at a pivot axis to the spike.

5. A hole cutting device as claimed in claim 4 wherein the handles each includes a cam portion which is able to contact and move the first cutting member towards the second cutting member when the handles are pivoted.

6. A hole cutting device as claimed in claim 5 wherein the core each of the handles is threaded, so the cam portion may simply be screwed onto the spike so as to move the first cutting member towards the second cutting member.

7. A hole cutting device as claimed in claim 4 wherein the handles include a substantially curved end portion extending past the pivot axis, said curved end portion being capable of contacting and moving the first cutting member towards the second cutting member, as the handles are pivoted.

8. A hole cutting device as claimed in claim 7 wherein the handles pivot about a point off-centre with the central longitudinal axis/axes of the handles; such that dependent on the orientation of the handles the first cutting member may be positioned, prior to pivoting the handles, either closer to, or further away, from the second cutting member.

9. A hole cutting device as claimed in claim 1 wherein the first cutting member includes an aperture of a size and shape that substantially corresponds to the transverse cross-sectional profile of the spike on which it is to be located, to allow the first cutting member to easily slide along the spike.

10. A hole cutting device as claimed in claim 9 wherein the second cutting member includes an aperture of a size and shape that substantially corresponds to the transverse cross-sectional profile of the spike on which it is to be located, to allow the second cutting member to easily slide along the spike.

11. A hole cutting device as claimed in claim 10 wherein the aperture of the second cutting member is shaped/orientated so that it is capable of interlocking with a recess/protrusion on the spike.

12. A hole cutting device as claimed in claim 11 wherein the second cutting member respectively interlocks with the recess/protrusion on the spike when it is rotated from a first orientation to a second orientation—such that the recess/protrusion on the spike prevents the second cutting member being slid back of the spike.

13. A hole cutting device as claimed in claim 11 wherein the second cutting member is joined to the spike via a pin which passes through the spike and protrudes therefrom to prevent the second member from moving back off the spike.

14. A hole cutting device as claimed in claim 1 wherein the cutting edges of the first and second cutting members have a substantially rectangular outline so as to cut a rectangular hole in the sheet of material.

15. A kit of parts for assembling a hole cutting device, said kit including:

a) a spike having a tip end and capable of being driven through a sheet of material;

b) at least one manually operated handle which is or can be located on the spike at the opposite end to that of the tip end;

c) a first cutting member having at least one cutting edge and capable of being located on, the spike such that:

(i) the first cutting member is positioned substantially adjacent the handle; and (ii) said first cutting member capable of being moved along the spike by said at least one handle;

(iii) the cutting edge of the first cutting member can be positioned substantially adjacent a first side of the sheet of material, d) a second cutting member having at least one cutting edge and capable of being located on the spike such that:

(i) the spike is joined with the second cutting member; and (ii) the at least one cutting edge of the second cutting member can be positioned substantially adjacent a second side of the sheet of material.

* * * * *